US006149238A

United States Patent [19]

Tsai

[11] Patent Number: 6,149,238

[45] Date of Patent: Nov. 21, 2000

[54] STRUCTURE OF ARM OF A FOLDING CHAIR

[76] Inventor: Ting-Sheng Tsai, No. 14, Alley 1, Lane 110, Da-Yung St., Kang Shan Chen, Kaohsiung Hsien, Taiwan

[21] Appl. No.: 09/457,075

[22] Filed: Dec. 9, 1999

[51] Int. Cl.[7] ..... A47C 5/04

[52] U.S. Cl. ..... 297/411.43; 297/41; 297/45; 297/188.4; 297/188.19

[58] Field of Search ..... 297/188.14, 188.19, 297/411.2, 411.26, 411.3, 411.32, 411.43, 16.1, 35, 40, 59, 45, 36, 41

[56] References Cited

U.S. PATENT DOCUMENTS 3,635,520 1/1972 Roher et al. .
4,652,047 3/1987 Chan .
5,746,479 5/1998 Bodnar .
5,893,605 4/1999 Chang .
5,984,406 11/1999 Lee .

*Primary Examiner*—Milton Nelson, Jr.
*Attorney, Agent, or Firm*—Rosenberg, Klein & Lee

[57] ABSTRACT

A structure of arm of a folding chair, particularly for a director's chair or a Wassily chair, comprised of an abutment, an arm-rest, and an elevation seat operated in conjunction with leg, splat tube, and webbing of the canvas seat; within, said abutment is provided at the upper end of the front leg and connected to a spring catch while one corresponding bore is provided at the front section of the arm rest, a recess with a lid is provided in the arm rest, and the rear end of the arm rest is pivoted to the front end of the elevation seat, a sleeve inserted onto the splat tube is provided on the elevation seat, the rear of the elevation seat is fixed with the webbing and can rest on the abutment by the front section of the arm rest then the spring catch on the abutment can be fixed in position in the bore at the front section of the arm rest so to fix it onto the leg.

6 Claims, 7 Drawing Sheets

STRUCTURE OF ARM OF A FOLDING CHAIR

BACKGROUND OF THE INVENTION

1. Field of the Invention

The present invention relates to a structure of arm of a folding chair, and more particularly to a foldable arm of a director's chair or a Wassily chair.

2. Description of the Prior Art

As illustrated in FIG. 7 of the accompanying drawings to the present invention, the prior art of a folding canvas chair is comprised of members of a leg frame(4), a splat tube(5) and a canvas seat(6). Within, the arm (61) is also made of canvas and is integrated with the canvas seat(6) comprised of a seat(62) and a splat(63) while the leg frame(4) is comprised of four sets of X-type tube frames (41) and (42) arranged in a rectangular, each set of frames (41) and (42) are formed with two tubes (411 and 412 or 421 and 422) pivoted at their centers and two neighboring sets of the frame (41) or (42) are separately pivoted with tubes (411) (412) or tubes (421)(422) to a base (43) and those bases(43) constitute those eight ends of the rectangular while the upper four bases(43) support the seat(62) and those four rear bases(43) may further be inserted with an erect splat tube(5) to join the splat(63), and the arm(61) is suspended at its rear end with a webbing(64) to the upper end of the splat(63) and the front end of the arm(61) is suspended at a horizontal receiving section(413) curved and extended from the front tube frame(41). To fold the chair, the seat(62) and the splat(63) are pulled up to retract those four sets of tube frames(41 & 42) at their pivots so that the arm can be folded accordingly. However, the arm(61) is not providing any rigidity, a cup, or similar beverage container is vulnerable to tilt over even a small canvas bag(61 1) is provided in recess of the arm(61). Arm made of plastic material providing with better rigidity may be a solution but it can not be folded.

SUMMARY OF THE INVENTION

The primary objective of the present invention is to provide a folding chair arm structure comprised of an abutment, an arm rest and an elevation seat operated in conjunction with leg, splat tube, and webbing of the canvas seat; within, said abutment is provided at the upper end of the front leg and connected to a spring catch while one corresponding bore is provided at the front section of the arm rest, a recess with a lid is provided in the arm rest, and the rear end of the arm rest is pivoted to the front end of the elevation seat, a sleeve inserted onto the splat tube is provided on the elevation seat, the rear of the elevation seat is fixed with the webbing and can rest on the abutment by the front section of the arm rest, then the spring catch on the abutment can be fixed in position in the bore at the front section of the arm rest so to fix it onto the leg, and to be folded up in the chair.

DETAILED DESCRIPTION OF THE INVENTION

Figure 1:
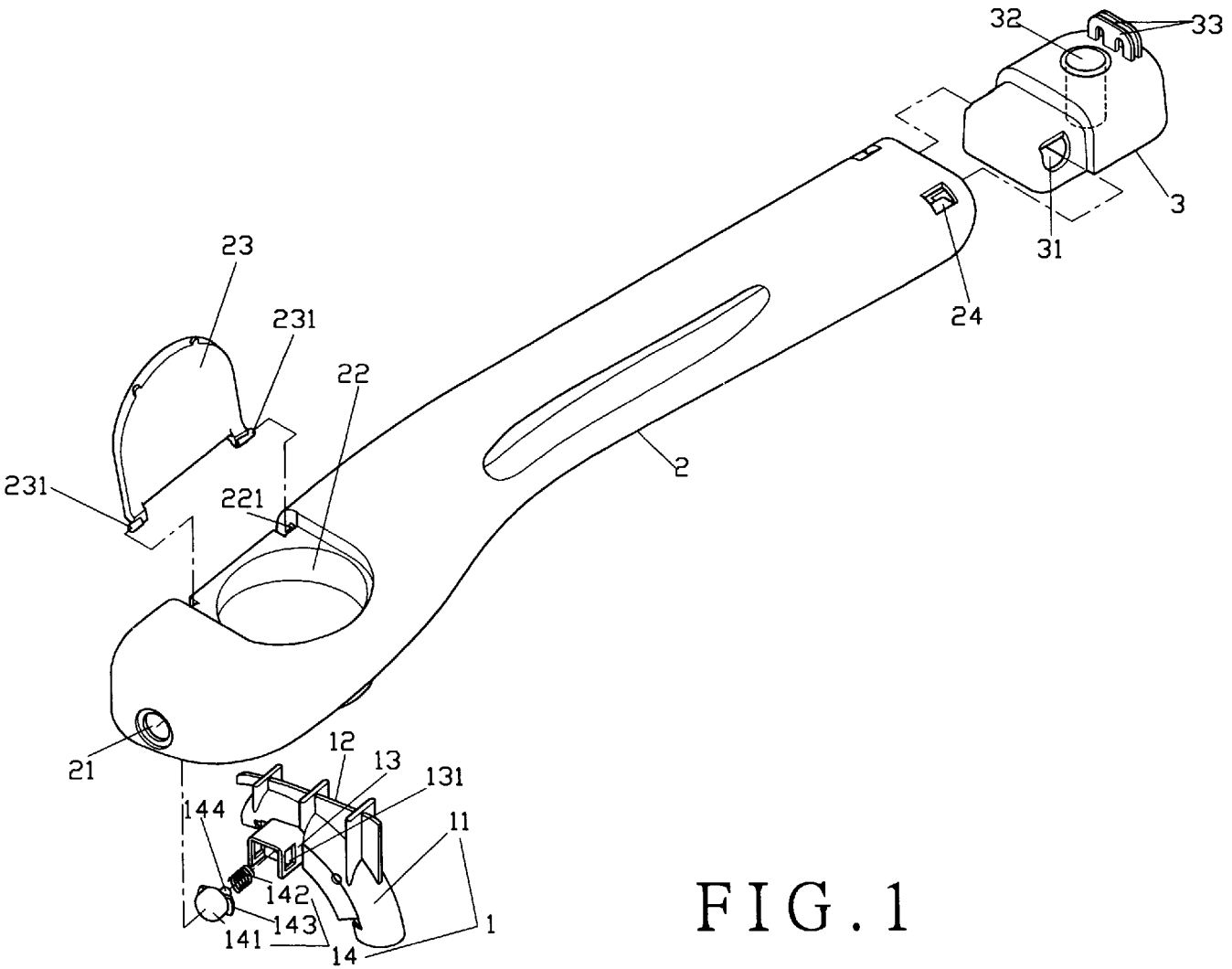
FIG. 1 is a blowout view of the present invention.

Referring to FIG. 1, a preferred embodiment of the present invention is comprised of an abutment(l), an arm rest(2) and an elevation seat(3) members in conjunction with leg frame(4), splat tube(5) and canvas seat(6) of the prior art. Within, the abutment (1) is a curved tube (11) provided with a multiple of ribs(12) to abut on the arm rest(2), the front of the curved tube (11) extends outward two protruding plates (13) in parallel with each providing a guiding channel(131). A spring catch(14) comprised of a catch(141) holding against a spring(142) is provided between said two protruding plates(13). Said catch(141) is in mushroom shape with it both sides each protruding a guiding wing(143) to slide and jam into the guiding channel(131) of the protruding plate(13) while a rod(144) is provided at the rear end of said catch(141) to be inserted into the spring (142) for the catch(141) to hold out in its normal condition by the force from the spring(142).

A bore(21) is provided on the front section of the arm rest(2) at where corresponding to the catch(141). A recess (22) is separately provided also in the front section of the arm rest(2) with one bore(221) provided at both ends of the external side of the recess (22) to be pivoted by the insertion of two tabs(231) respectively protruding from both ends of a lid(23). One tag(24) protruding inward beneath both sides at the rear section of the arm rest(2) to be pivoted to the elevation seat(3).

One bore(31) is each provided at both sides of the front end of the elevation seat(3) at where corresponding to said tab(24), and on the elevation seat a sleeve(32) is separately provided to be inserted onto the splat tube(5). A protruding plate(33)(also bored but not illustrated in the drawing) is provided at the rear section of the elevation seat(3) to be fixed by the webbing(61) from the canvas seat(6) with a nail.

Figure 2:
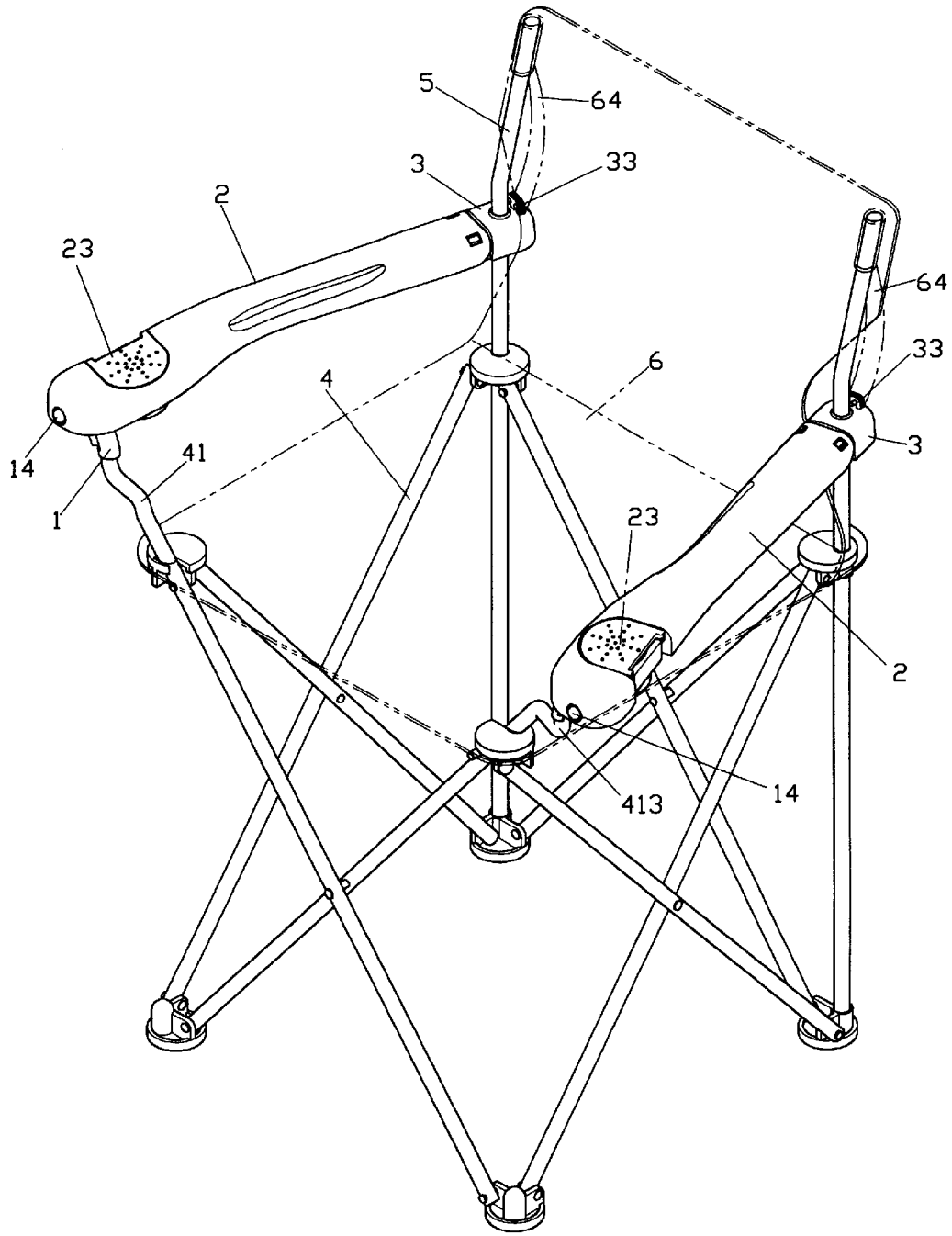
FIG. 2 is a perspective view showing the application of the present invention onto a folding chair.
Figure 3:
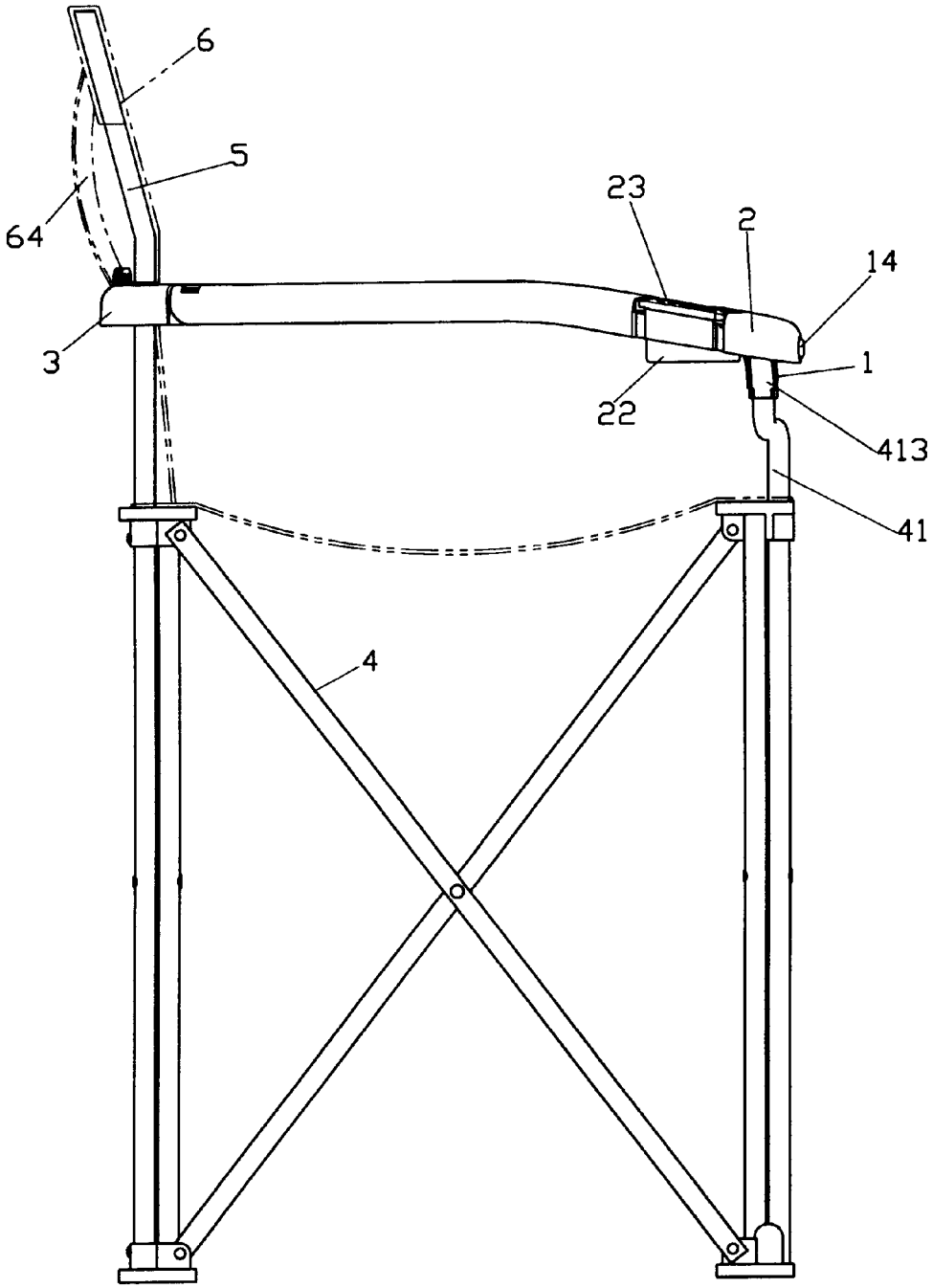
FIG. 3 is a side view showing the application of the present invention onto a folding chair.
Figure 4:
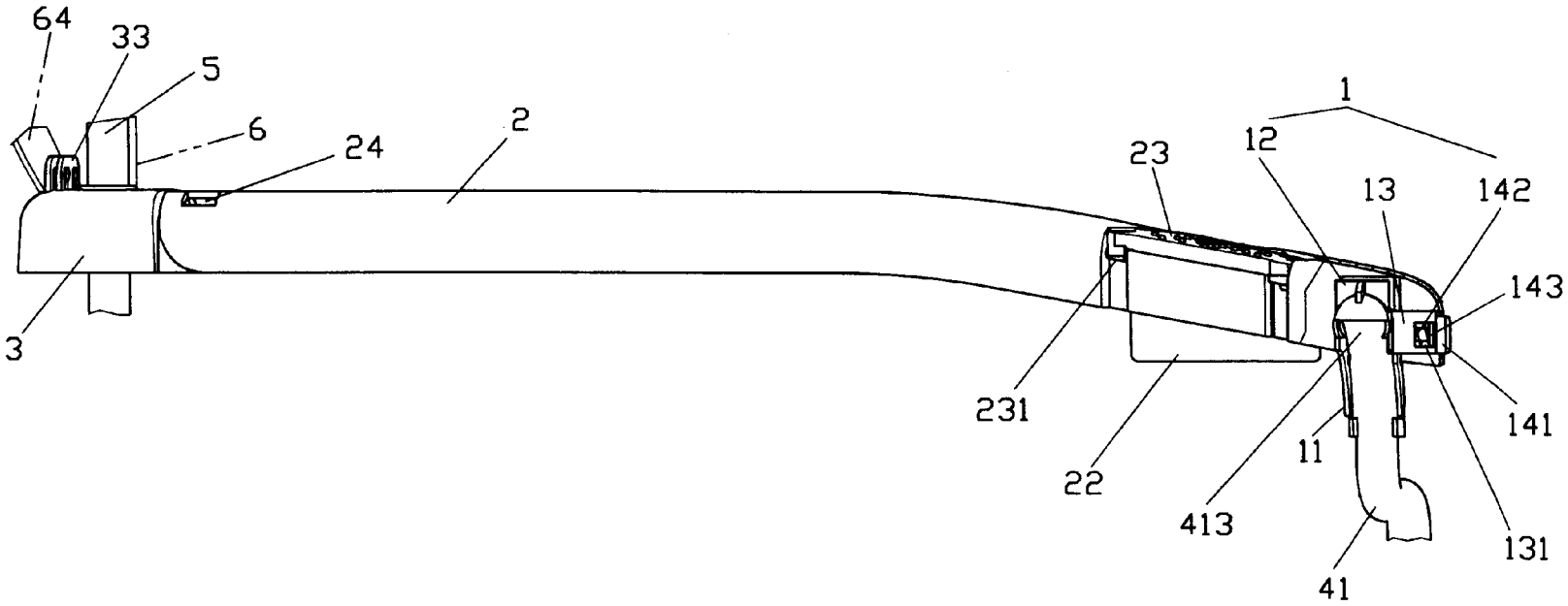
FIG. 4 is an enlarged longitudinal sectional view of the present invention.
Figure 5:
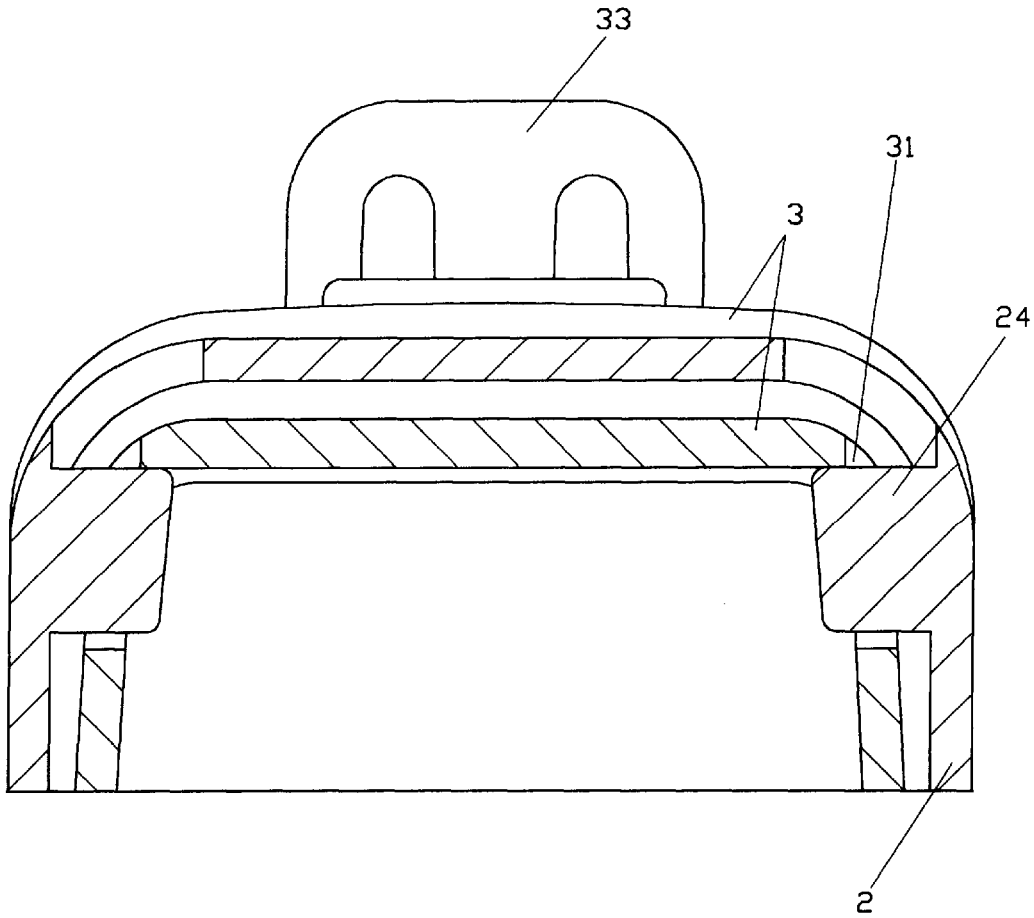
FIG. 5 is a cross sectional view of the pivot of arm of the present invention.

Now referring to FIGS. 2 and 3, within, the abutment(l) is inserted and fixed to a receiving section(413) provided at the upper end of the front tube frame(41) from the leg frame(4) with the curved tube(1) and the canvas seat(6) is abutted to the leg frame(4). The splat tube(5) is also provided behind the leg frame(4). The front end of the arm rest(2) is held in position with the catch(141) from the spring catch(14) accommodated in the bore(21) as illustrated in FIG. 4; and the rear end of the arm rest, as illustrated in FIG. 5, is pivoted to the elevation seat(3) by the tab (24) holding against the bore(31) for the arm rest(2) to be caught and fixed onto the leg frame(4).

Figure 6:
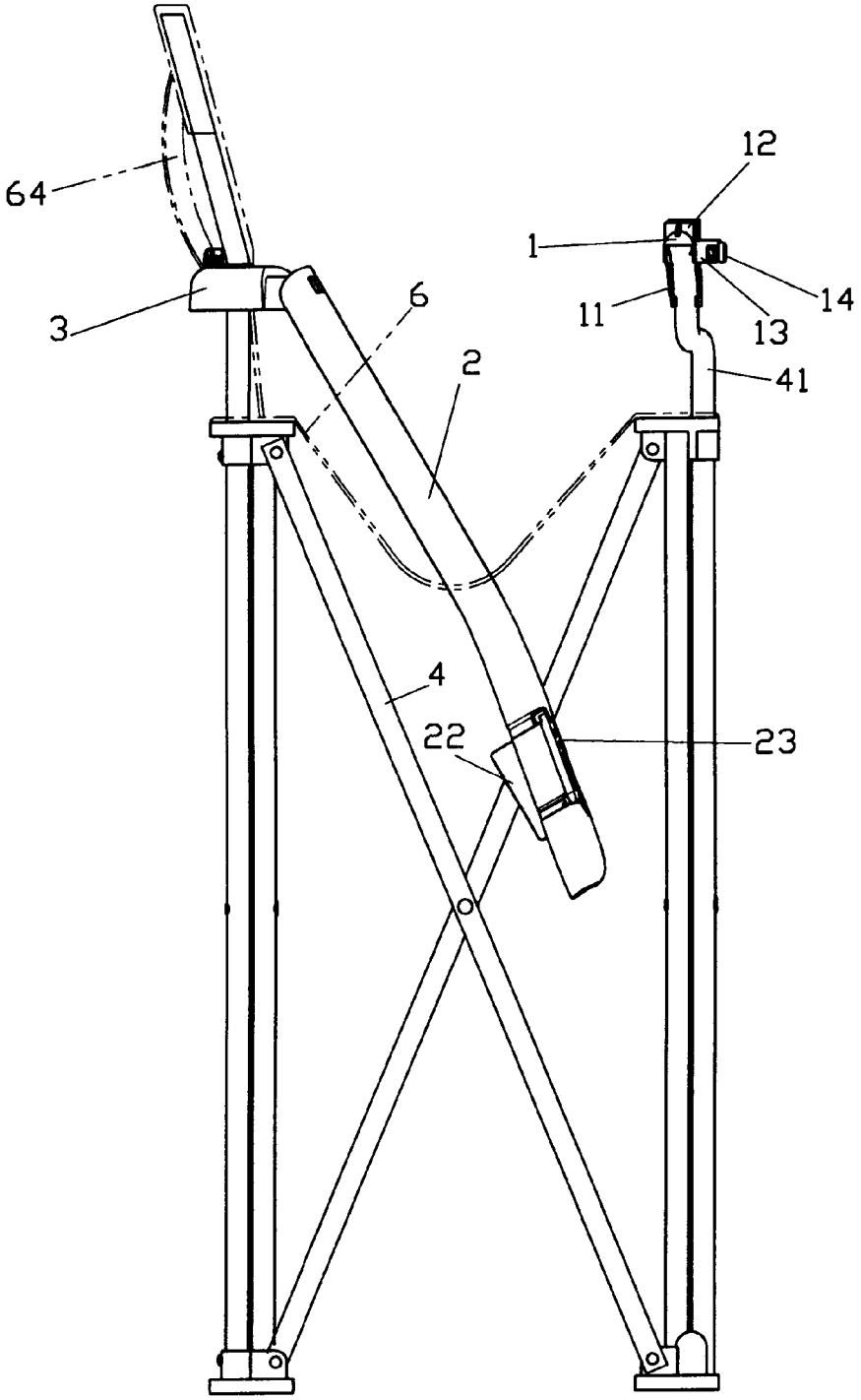
FIG. 6 is a schematic view showing the operation of the present invention.
Figure 7:
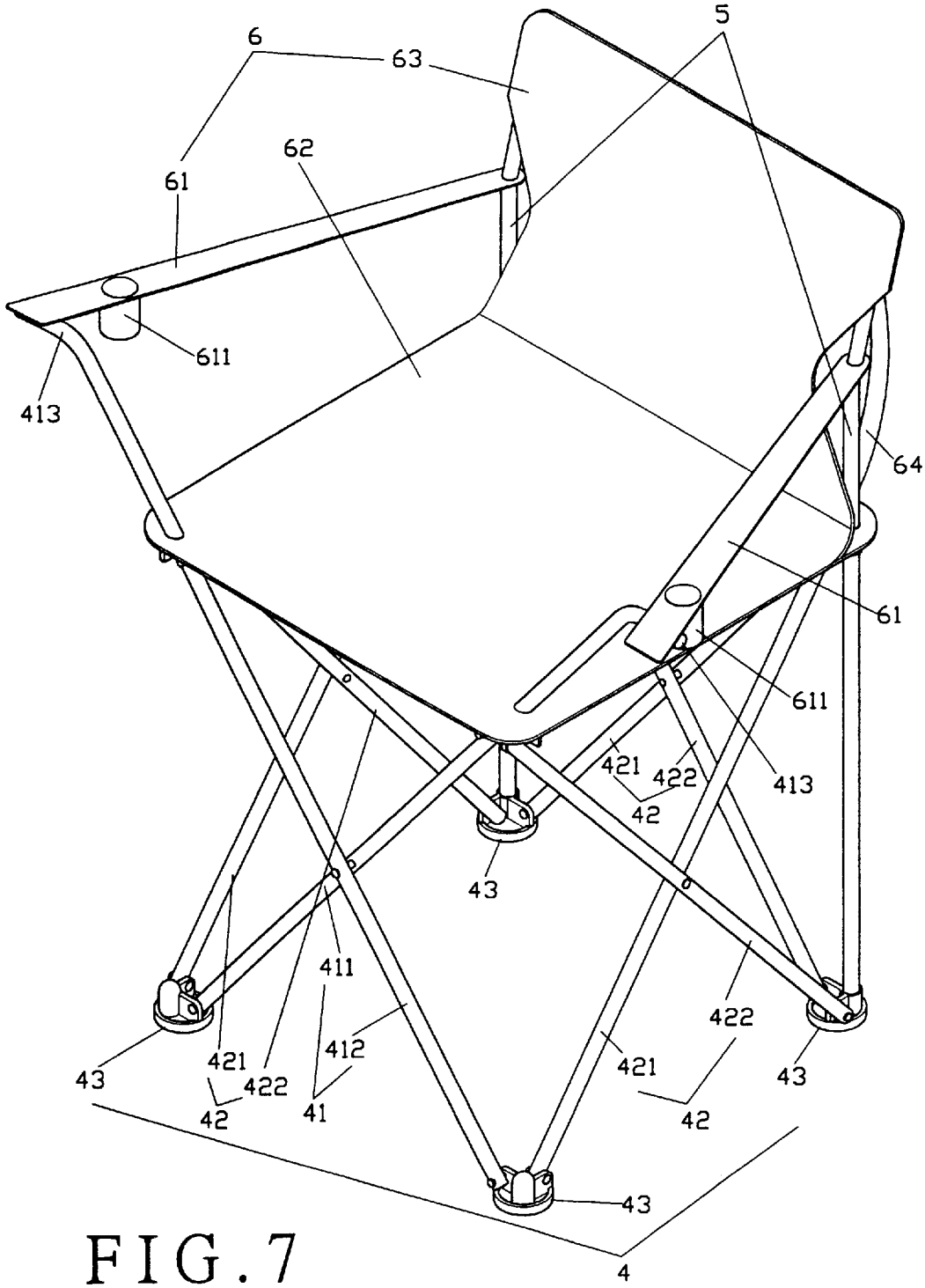
FIG. 7 (PRIOR ART)
FIG. 7 is a schematic view showing a prior art of a folding chair.

While in use, the lid(23) to the arm rest(2) may be opened up to expose the recess(22) to receive cup or similar beverage container; and when folded up, the spring catch (14) is pressed for the catch to leave the bore(21) and the arm rest(2) to disengage from the abutment(l) as illustrated in FIG. 6. When the canvas seat(6) is pulled up, the webbing (61) also pulls up the elevation seat(3), and both of the elevation(3) and the arm rest(2) are turned in the opposite direction to fold up the chair thus to solve the problem of the prior art with hard board arm rest that prevents from being folded up.

I claim:

1. An arm structure for a folding chair, comprised of an abutment, an arm rest and an elevation seat operated in conjunction with a canvas seat provided with a leg frame, splat tube and webbing, wherein, the abutment is provided at an upper end of a front tube frame of said leg frame with a spring catch, a corresponding bore is provided at a front section of the arm rest, a recess with a lid is provided in the arm rest while a rear end of the arm rest is pivoted to a front end of an elevation seat, a tube on the elevation seat is inserted on to the splat tube, a rear section of the elevation seat is fixed with the webbing and can be abutted to the abutment by means of the front section of the arm rest, the abutment is held in position in the bore at the front section of the arm rest by the spring catch from the abutment to fix the arm rest to the leg.

2. An arm structure for a folding chair as claimed in claim 1, wherein, the abutment is made of a curved tube with its upper end provided with ribs, two protruding plates extend outwardly in parallel from a front portion of the curved tube, a guiding channel is provided on each protruding plate and a spring catch is provided between said two protruding plates.

3. An arm structure for a folding chair as claimed in claim 2, wherein, the spring catch is comprised of a catch holding against a spring, the catch having a mushroom shape with a guiding wing protruding from two sides thereof and respectively extending into the guiding channel of a corresponding one of said two protruding plates.

4. An arm structure for a folding chair as claimed in claim 1, wherein, the elevation seat includes a sleeve for passage of the splat tube therethrough.

5. An arm structure for a folding chair as claimed in claim 1, wherein, the arm rest has a pair of bores respectively formed in two ends on one side of the recess, and the lid includes tabs respectively protruding from two ends on one side of the lid, said tabs being respectively inserted into said pair of bores to pivotally couple said lid to said arm rest.

6. An arm structure for a folding chair as claimed in claim 1, wherein, the rear end of the arm rest is provided with a pair of inwardly protruding tabs respectively formed on two sides thereof, the front end of the elevation seat being provided with a pair of corresponding bores to receive said tabs therein.

* * * * *